US010358779B2

(12) United States Patent
Comer et al.

(10) Patent No.: US 10,358,779 B2
(45) Date of Patent: Jul. 23, 2019

(54) APPARATUS AND METHOD FOR A SCREED EXTENSION CONTROL SYSTEM

(71) Applicant: Carlson Paving Products, Inc., Tacoma, WA (US)

(72) Inventors: Kevin Comer, Buckley, WA (US); Travis Honegger, Yelm, WA (US)

(73) Assignee: Carlson Paving Products, Inc., Tacoma, WA (US)

( * ) Notice: Subject to any disclaimer, the term of this patent is extended or adjusted under 35 U.S.C. 154(b) by 150 days.

(21) Appl. No.: 15/632,793

(22) Filed: Jun. 26, 2017

(65) Prior Publication Data

US 2017/0370051 A1 Dec. 28, 2017

Related U.S. Application Data

(60) Provisional application No. 62/354,867, filed on Jun. 27, 2016.

(51) Int. Cl.
*E01C 19/42* (2006.01)
*E01C 19/48* (2006.01)

(52) U.S. Cl.
CPC ..... *E01C 19/42* (2013.01); *E01C 19/48* (2013.01); *E01C 2301/14* (2013.01)

(58) Field of Classification Search
CPC ..... E01C 19/42; E01C 19/48; E01C 19/43; E01C 2301/14; E01C 2301/16
See application file for complete search history.

(56) References Cited

U.S. PATENT DOCUMENTS

| | | | | | |
|---|---|---|---|---|---|
| 5,568,992 | A * | 10/1996 | Grembowicz | E01C 19/48 | 404/101 |
| 5,863,149 | A * | 1/1999 | Gustin | E01C 19/48 | 404/101 |
| 5,924,819 | A * | 7/1999 | Breidenbach | E01C 19/42 | 404/104 |
| 7,909,534 | B1 * | 3/2011 | Comer | E01C 19/42 | 404/118 |
| 8,128,314 | B2 * | 3/2012 | Buschmann | E01C 19/48 | 404/104 |
| 8,221,025 | B2 * | 7/2012 | Buschmann | E01C 19/48 | 404/75 |
| 2002/0106242 | A1 * | 8/2002 | Rahn | E01C 19/42 | 404/96 |
| 2011/0091278 | A1 * | 4/2011 | Munz | E01C 19/40 | 404/118 |

(Continued)

*Primary Examiner* — Abigail A Risic
(74) *Attorney, Agent, or Firm* — Chambliss, Bahner & Stophel, P.C.

(57) ABSTRACT

A screed extension control system adapted for use on a screed assembly having a main screed, a main screed contact surface, a screed extension, and a screed extension contact surface. The screed extension control system comprises a slope actuator, a height actuator, at least one sensor, and a controller that is adapted to receive feedback from the at least one sensor. A virtual pivot point location is defined by a position where the main screed contact surface and the screed extension contact surface intersect. The controller causes at least one of the slope actuator and the height actuator to move between an extended position and a retracted position to control the position of the virtual pivot point location along the length of the main screed. A method for adjusting the screed extension position relative to the main screed.

19 Claims, 15 Drawing Sheets

(56) References Cited

U.S. PATENT DOCUMENTS

| | | | | |
|---|---|---|---|---|
| 2012/0183350 | A1* | 7/2012 | Mittleman | E01C 19/48<br>404/101 |
| 2014/0301782 | A1* | 10/2014 | Mittleman | E01C 19/48<br>404/84.1 |
| 2014/0301784 | A1* | 10/2014 | Kopacz | E01C 19/48<br>404/118 |
| 2016/0040369 | A1* | 2/2016 | Wang | E01C 19/48<br>404/114 |
| 2016/0237629 | A1* | 8/2016 | Rio | E01C 19/22 |

* cited by examiner

APPARATUS AND METHOD FOR A SCREED EXTENSION CONTROL SYSTEM

CROSS-REFERENCES TO RELATED APPLICATIONS/PATENTS

This application relates back to and claims the benefit of priority from U.S. Provisional Application for Patent Ser. No. 62/354,867 titled "Slope Extension" and filed on Jun. 27, 2016.

FIELD OF THE INVENTION

The present invention relates generally to apparatuses and methods for adjusting screed extensions and particularly to apparatuses and methods for automatically adjusting screed extensions relative to main screeds.

BACKGROUND AND DESCRIPTION OF THE PRIOR ART

A screed is typically towed behind an asphalt paving machine in order to establish the thickness, and to some extent the density, of a layer or mat of asphalt paving material which has been applied to a base surface to produce a roadway or parking lot. Some screeds provide a screed extension which allows the screed to cover a wider area. Some screed extensions are adapted to be sloped which creates a sloped edge on the asphalt to provide a safer driving surface. Conventional screed extensions that are adapted to be sloped suffer from one or more limitations. For example, the pivot points of conventional screed extensions adapted to be sloped are mechanically located on the main screed above the main screed contact surface. Thus, the point of intersection between the main screed and the screed extension moves along the length of the main screed when the angle of the slope of the screed extension is adjusted. This mechanical limitation causes conventional screed extensions to be limited in their ability to meet certain road specifications accurately. In addition, changing the slope of conventional screed extensions is both time-consuming and labor-intensive and exposes users to hazards.

It would be desirable, therefore, if an apparatus and method for a screed extension control system could be provided that would be adapted to adjust the slope of the screed extension without moving the pivot point where the contacting surface of the main screed and the contacting surface of the screed extension intersect, i.e. the virtual pivot point location, along the length of the main screed. It would be further desirable if an apparatus and a method for a screed extension control system could be provided that would be adapted to meet a broader range of road specifications accurately. It would also be desirable if an apparatus and method for a screed extension control system could be provided that would be adapted to be less time-consuming, labor-intensive, and hazardous to the user.

ADVANTAGES OF THE PREFERRED EMBODIMENTS OF THE INVENTION

Accordingly, it is an advantage of the preferred embodiments of the invention claimed herein to provide an apparatus and method for a screed extension control system that maintains a virtual pivot point location along the length of the main screed. It is an advantage of the preferred embodiments of the invention claimed herein to provide an apparatus and method for a screed extension control system that more accurately satisfies road specifications. It is also an advantage of the preferred embodiments of the invention claimed herein to provide an apparatus and method for a screed extension control system that is less labor-intensive, time-consuming, and hazardous to the user.

Additional advantages of the preferred embodiments of the invention will become apparent from an examination of the drawings and the ensuing description.

EXPLANATION OF THE TECHNICAL TERMS

The use of the terms "a", "an", "the" and similar terms in the context of describing the invention are to be construed to cover both the singular and the plural, unless otherwise indicated herein or clearly contradicted by context. The terms "comprising", "having", "including" and "containing" are to be construed as open-ended terms (i.e., meaning "including, but not limited to,") unless otherwise noted. The terms "substantially", "generally" and other words of degree are relative modifiers intended to indicate permissible variation from the characteristic so modified. The use of such terms in describing a physical or functional characteristic of the invention is not intended to limit such characteristic to the absolute value which the term modifies, but rather to provide an approximation of the value of such physical or functional characteristic. All methods described herein can be performed in any suitable order unless otherwise specified herein or clearly indicated by context.

Terms concerning attachments, coupling and the like, such as "connected" and "interconnected", refer to a relationship wherein structures are secured or attached to one another either directly or indirectly through intervening structures, as well as both moveable and rigid attachments or relationships, unless specified herein or clearly indicated by context. The term "operatively connected" is such an attachment, coupling or connection that allows the pertinent structures to operate as intended by virtue of that relationship.

The use of any and all examples or exemplary language (e.g., "such as" and "preferably") herein is intended merely to better illuminate the invention and the preferred embodiments thereof, and not to place a limitation on the scope of the invention. Nothing in the specification should be construed as indicating any element as essential to the practice of the invention unless so stated with specificity. Several terms are specifically defined herein. These terms are to be given their broadest reasonable construction consistent with such definitions, as follows:

The term "linear actuator" refers to an electric, pneumatic, hydraulic, electro-hydraulic or mechanical device that generates force which is directed in a straight line. Common examples of "linear actuators" are hydraulic cylinders and pneumatic cylinders.

The term "asphalt paving material(s)" refers to a bituminous paving mixture that is comprised of an asphaltic binder and aggregate materials of various types and particle sizes, including both coarse and fine aggregate materials.

The terms "asphalt paving machine", "paving machine" and similar terms refer to a finishing machine for applying asphalt paving material to form an asphalt mat on a roadway, parking lot or similar surface.

The term "paving direction", when used in describing the operation of an asphalt paving machine or the relative position of an asphalt paving machine, a screed or another component of a paving machine, refers to the direction of advance of the asphalt paving machine as the paving operation is carried out.

The term "screed" refers to a device that is generally used in connection with an asphalt paving machine in order to establish the thickness, and to some extent the density, of an asphalt mat.

The terms "front" and "front end" of the asphalt paving machine refer to the end of the machine that leads in the paving direction. When referring to a screed or other component of the paving machine, the terms "front" and "front end" refer to that portion of the screed or component that is nearer the front end of the asphalt paving machine.

The terms "rear" and "rear end" of the asphalt paving machine refer to the end of the paving machine opposite the front end. When referring to a screed or other component of the paving machine, the terms "rear" and "rear end" refer to that portion of the screed or component that is nearer the rear end of the paving machine.

The terms "forward" and "in front of", as used herein to describe a relative position or direction on or in connection with an asphalt paving machine or a screed or other component of the paving machine, refer to a relative position towards the front end of the machine.

The terms "rearward", "behind" and "rearwardly", as used herein to describe a relative position or direction on or in connection with an asphalt paving machine, a screed or other component of the paving machine, refer to a relative position or direction towards the rear end of the machine.

The term "right", when used herein to describe a relative position or direction on or in connection with an asphalt paving machine, or a screed or other component thereof, refers to the right side of the machine, screed or component from the perspective of an operator who is driving the paving machine in the paving direction.

The term "left", when used herein to describe a relative position or direction on or in connection with an asphalt paving machine or a screed or other component thereof, refers to the left side of the machine, screed or component from the perspective of an operator who is driving the paving machine in the paving direction.

The term "in" includes both "entirely within" and "at least partially within."

The term "mechanical pivot point" refers to the point around which the screed extension physically pivots relative to the main screed.

The term "virtual pivot point" refers to the point along the length of the main screed at which the contacting surface of the screed extension intersects the contacting surface of the main screed and which translates to a corner on the asphalt mat.

SUMMARY OF THE INVENTION

The apparatus of the invention comprises a screed extension control system adapted for use on a screed assembly having a main screed, a main screed contact surface, a screed extension, and a screed extension contact surface. The preferred screed extension control system comprises a slope actuator having a slope actuator first end connected to the main screed and a slope actuator second end operatively connected to the screed extension, a height actuator having a height actuator first end operatively connected to the main screed and a height actuator second end operatively connected to the screed extension, at least one sensor that is adapted to determine a position of at least one of the slope actuator and the height actuator, and a controller that is adapted to receive feedback from the at least one sensor. In the preferred embodiments of the screed extension control system, a virtual pivot point location is defined by a position where the main screed contact surface and the screed extension contact surface intersect, the at least one sensor provides feedback to the controller, and the controller causes at least one of the slope actuator and the height actuator to move between an extended position and a retracted position to control the position of the virtual pivot point location along the length of the main screed.

The method of the invention comprises a method for adjusting a screed extension position relative to a main screed. The preferred method comprises providing a screed extension control system adapted for use on a screed assembly having a main screed, a main screed contact surface, a screed extension, and a screed extension contact surface. The preferred screed extension control system comprises a slope actuator having a slope actuator first end connected to the main screed and a slope actuator second end operatively connected to the screed extension, a height actuator having a height actuator first end operatively connected to the main screed and a height actuator second end operatively connected to the screed extension, at least one sensor that is adapted to determine a position of at least one of the slope actuator and the height actuator, and a controller that is adapted to receive feedback from the at least one sensor. In the preferred embodiments of the screed extension control system, a virtual pivot point location is defined by a position where the main screed contact surface and the screed extension contact surface intersect, the at least one sensor provides feedback to the controller, and the controller causes at least one of the slope actuator and the height actuator to move between an extended position and a retracted position to control the position of the virtual pivot point location along the length of the main screed. The preferred method also comprises adjusting the screed extension position relative to the main screed.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
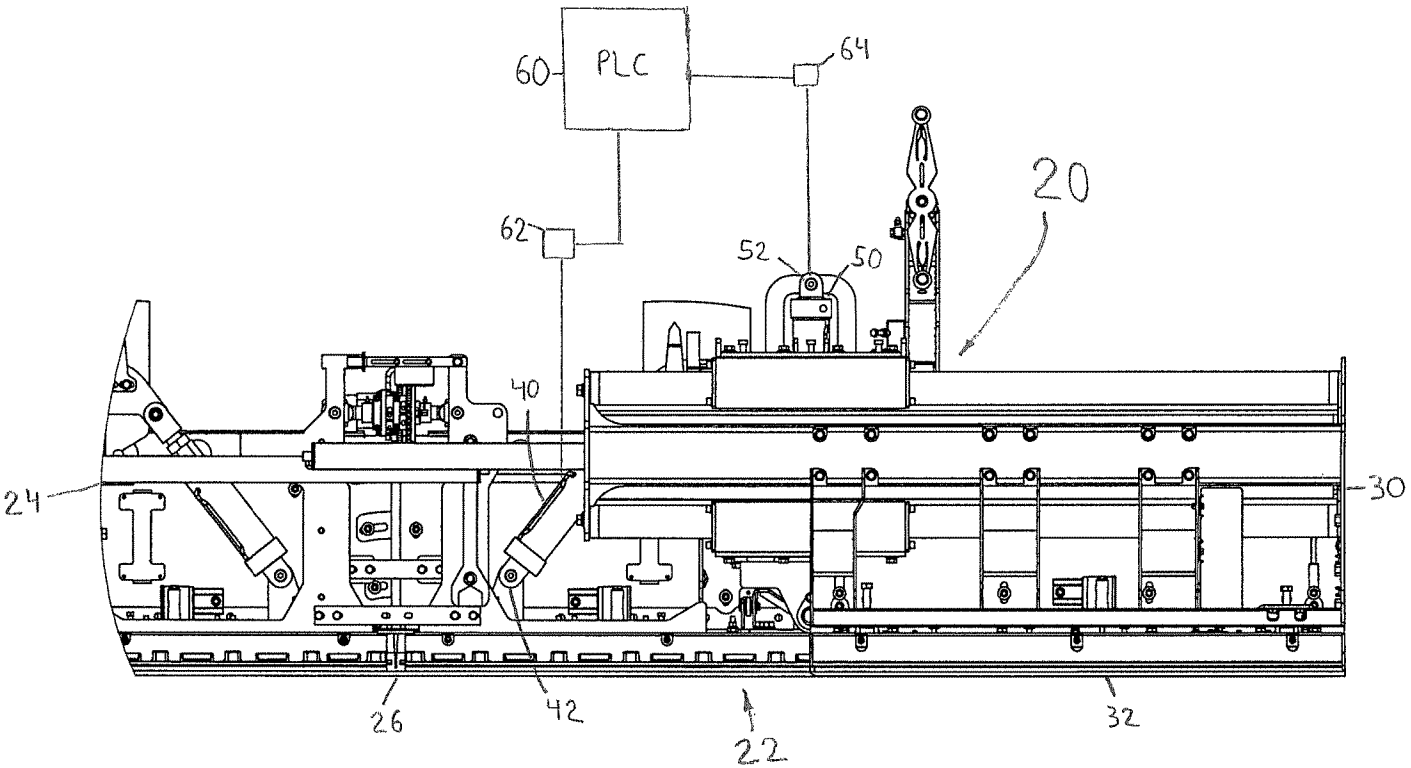
FIG. 1 is a back view of the preferred embodiment of the screed extension control system in accordance with the present invention wherein the screed extension is in a substantially horizontal position.

Referring now to the drawings, the preferred embodiment of the apparatus and method for a screed extension control system in accordance with the present invention is illustrated by FIGS. 1-3 and 7-15. As shown in FIGS. 1-3 and 7-15, the preferred embodiment of the screed extension control system is adapted to allow for a screed extension to slope and also maintain a virtual pivot point location on the main screed contact surface. The preferred embodiment of the screed extension control system is also adapted to allow the screed to meet broader range of road specifications accurately. In addition, the preferred embodiment of the screed extension control system is adapted to perform positioning of the screed extension relative to the main screed safely, more quickly, and with less labor.

Referring now to FIG. 1, a back view of the preferred embodiment of the screed extension control system in accordance with the present invention is illustrated. As shown in FIG. 1, the preferred screed extension control system is designated generally by reference numeral 20.

Preferred screed extension control system 20 is adapted for use on screed assembly 22 having main screed 24 with main screed contact surface 26 and screed extension 30 with screed extension contact surface 32.

Figure 10:
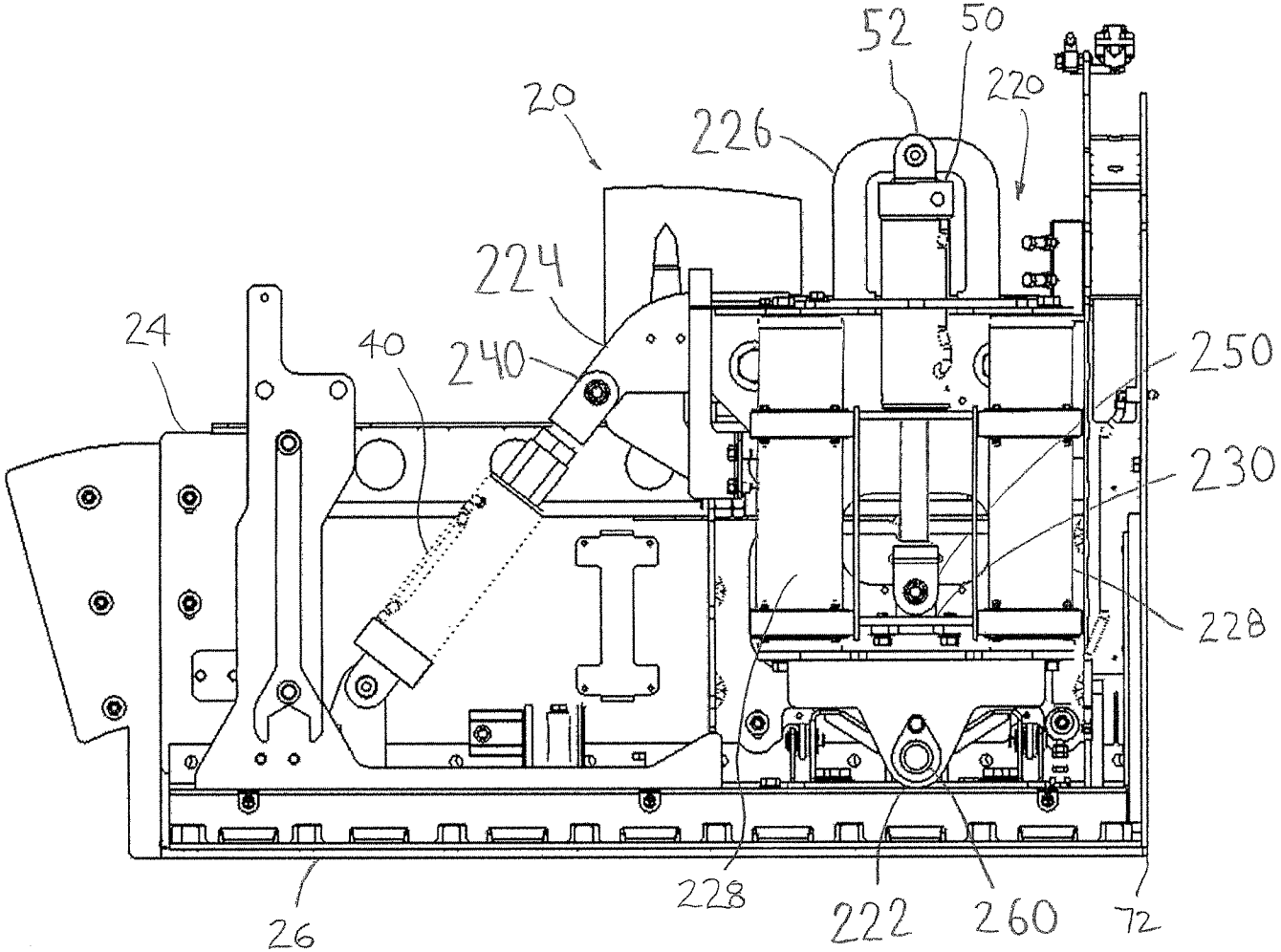
FIG. 10 is a back sectional view of the preferred screed extension control system illustrated in FIGS. 1-3 and 7-9 where the slope actuator is in a retracted position and the height actuator is in an extended position.

Still referring to FIG. 1, a position of screed extension 30 relative to main screed 24 is determined by the position of a slope actuator, such as slope hydraulic cylinder 40 having first end 42 and second end (see FIG. 10), and the position of a height actuator, such as height hydraulic cylinder 50 having first end 52 and second end (see FIG. 10). It is also contemplated within the scope of the invention that the slope actuator and the height actuator are any suitable types of actuators such as linear actuators, hydraulic cylinders, pneumatic cylinders, and the like. Preferred slope hydraulic cylinder first end 42 is connected to main screed 24. Preferred height hydraulic cylinder 50 comprises. Preferred height hydraulic cylinder first end 52 is operatively connected to main screed 24 (see FIG. 10).

Still referring to FIG. 1, preferred screed extension control system 20 further comprises a controller, such as programmable logic controller 60. It is also contemplated within the scope of the invention that the controller could comprise a microprocessor or circuitry that correlates slope actuator movement with height actuator movement.

Still referring to FIG. 1, preferred programmable logic controller 60 is adapted to receive feedback from at least one sensor. The preferred at least one sensor is adapted to determine a position of at least one of slope hydraulic cylinder 40 and height hydraulic cylinder 50. The preferred at least one sensor comprises slope actuator sensor 62 which provides feedback relating to the position of slope hydraulic cylinder 40 and height actuator sensor 64 which provides feedback relating to the position of height hydraulic cylinder 50. It is contemplated within the scope of the invention that the at least one sensor could be located inside at least one of the slope actuator and the height actuator. It is also contemplated within the scope of the invention that the at least one sensor could be located outside of the at least one of the slope actuator and the height actuator. It is also contemplated within the scope of the invention that the sensor may comprise any suitable device, mechanism, assembly, or combination thereof adapted to determine the relative position of the screed extension to the main screed. It is also contemplated within the scope of the invention that there is no sensor, and instead, preset adjustments of the slope actuator and height actuator are used to slope the screed extension while maintaining the virtual pivot point location along the length of the main screed. Preferred programmable logic controller 60 receives feedback from slope actuator sensor 62 and height actuator sensor 64 substantially continuously and substantially in real time.

Figure 2:
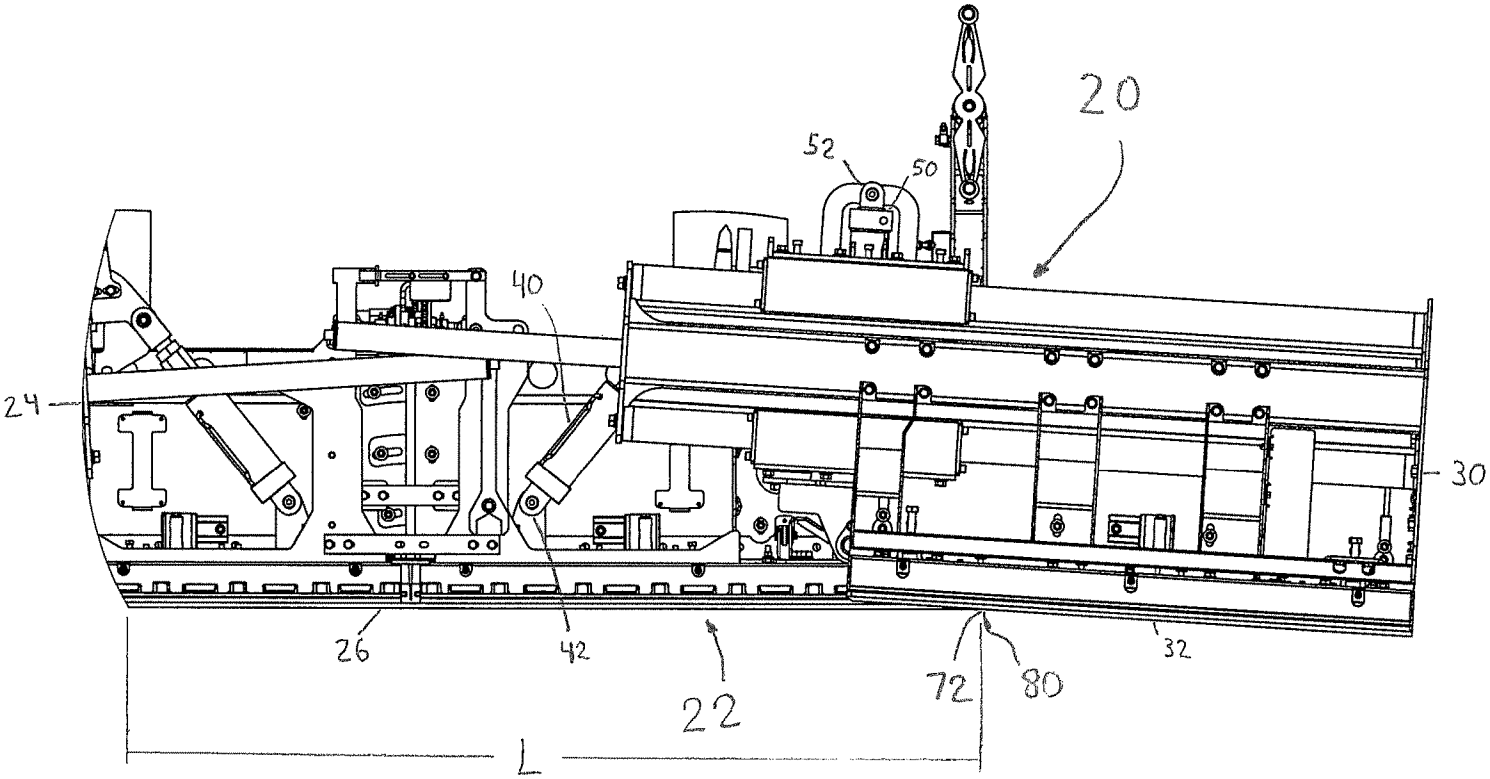
FIG. 2 is a back view of the preferred screed extension control system illustrated in FIG. 1 wherein the screed extension is in a partially sloped position.

Referring now to FIG. 2, a back view of preferred screed extension control system 20 is illustrated with preferred screed extension 30 in a partially sloped position. As shown in FIG. 2, preferred main screed 24 further comprises main screed contact surface length L and main screed contact surface edge 72. A location where main screed contact surface 26 intersects with screed extension contact surface 32 defines virtual pivot point location 80.

Still referring to FIG. 2, preferred programmable logic controller 60 causes at least one of slope hydraulic cylinder 40 and height hydraulic cylinder 50 to move between an extended position and a retracted position to control the position of virtual pivot point location 80 automatically as screed extension 30 moves between a substantially parallel position and a sloped position. It is also contemplated within the scope of the invention that the controller causes the actuators to move to affect the position of the virtual pivot point location after the screed extension moves between a substantially parallel position and a sloped position. Preferred programmable logic controller 60 maintains virtual pivot point location 80 on main screed contact surface edge 72 so that main screed contact surface length L remains substantially constant when screed extension 30 moves between a substantially parallel position and a sloped position. Preferred programmable logic controller 60 communicates with slope hydraulic cylinder 40 and height hydraulic cylinder 50 substantially continuously and substantially in real time.

Figure 3:
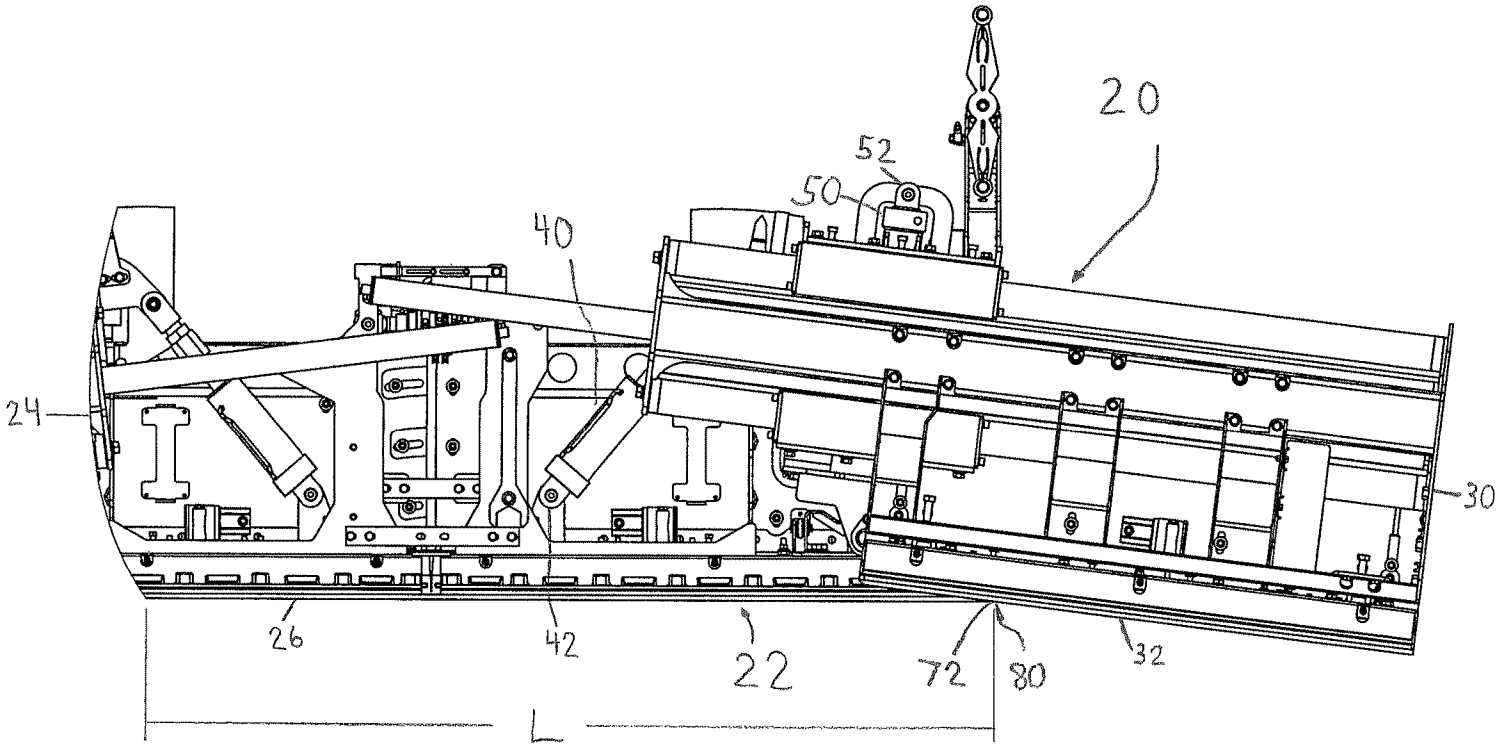
FIG. 3 is a back view of the preferred screed extension control system illustrated in FIGS. 1-2 wherein the screed extension is in a sloped position.

Referring now to FIG. 3, a back view of preferred screed extension control system 20 is illustrated with preferred screed extension 30 in a sloped position. As shown in FIG. 3, programmable logic controller 60 maintains virtual pivot point location 80 on main screed contact surface edge 72 by adjusting slope hydraulic cylinder 40 and height hydraulic cylinder 50 so that main screed contact surface length L remains substantially constant. While FIGS. 1-3 illustrate the preferred configuration and arrangement of the screed extension control system, it is contemplated within the scope of the invention that the screed extension control system may be of any suitable configuration and arrangement.

Figure 4:
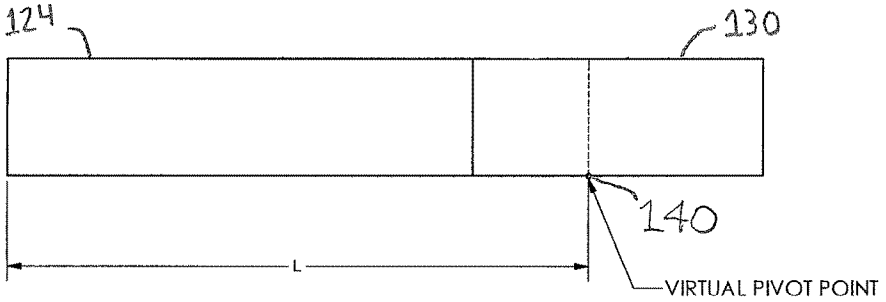
FIG. 4 is a schematic view of an exemplary main screed and an exemplary screed extension wherein the screed extension is in a substantially horizontal position.

Referring now to FIG. 4, a schematic view of exemplary main screed 124 and exemplary screed extension 130 which pivots around a virtual pivot point location is illustrated. Exemplary screed extension 130 is in a substantially horizontal position. As shown in FIG. 4, exemplary main screed 124 comprises exemplary main screed contact surface length L and exemplary main screed contact surface edge 140.

Figure 5:
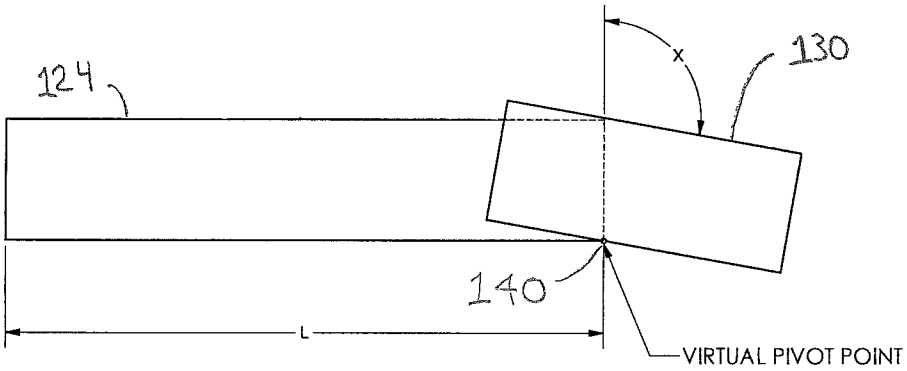
FIG. 5 is a schematic view of an exemplary main screed and an exemplary screed extension wherein the screed extension is in a partially sloped position.

Referring now to FIG. 5, a schematic view of exemplary main screed 124 and exemplary screed extension 130 in a partially sloped position is illustrated (see angle X). As shown in FIG. 5, exemplary screed extension control system 120 maintains the virtual pivot point location on exemplary main screed contact surface edge 140 so that main screed contact surface length L stays substantially constant.

Figure 6:
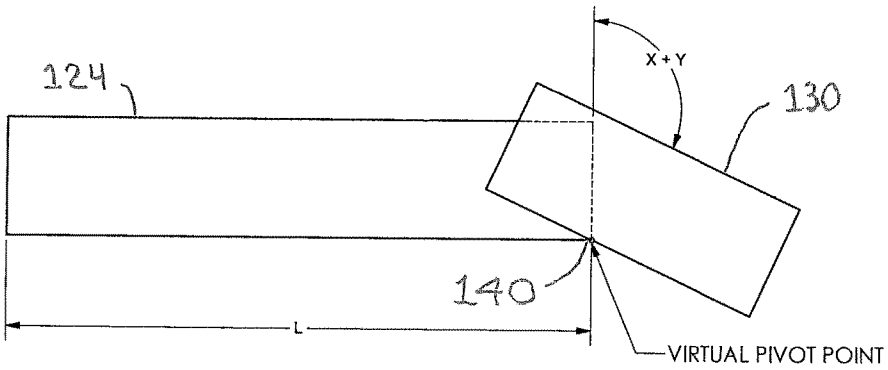
FIG. 6 is a schematic view of an exemplary main screed and an exemplary screed extension wherein the screed extension is in a sloped position.

Referring now to FIG. 6, a schematic view of exemplary main screed 124 and exemplary screed extension 130 in a more sloped position is illustrated (see angle X+Y). As shown in FIG. 6, exemplary screed extension control system 120 still maintains the virtual pivot point location on exemplary main screed contact surface edge 140 so that main screed contact surface length L stays substantially constant.

Figure 7:
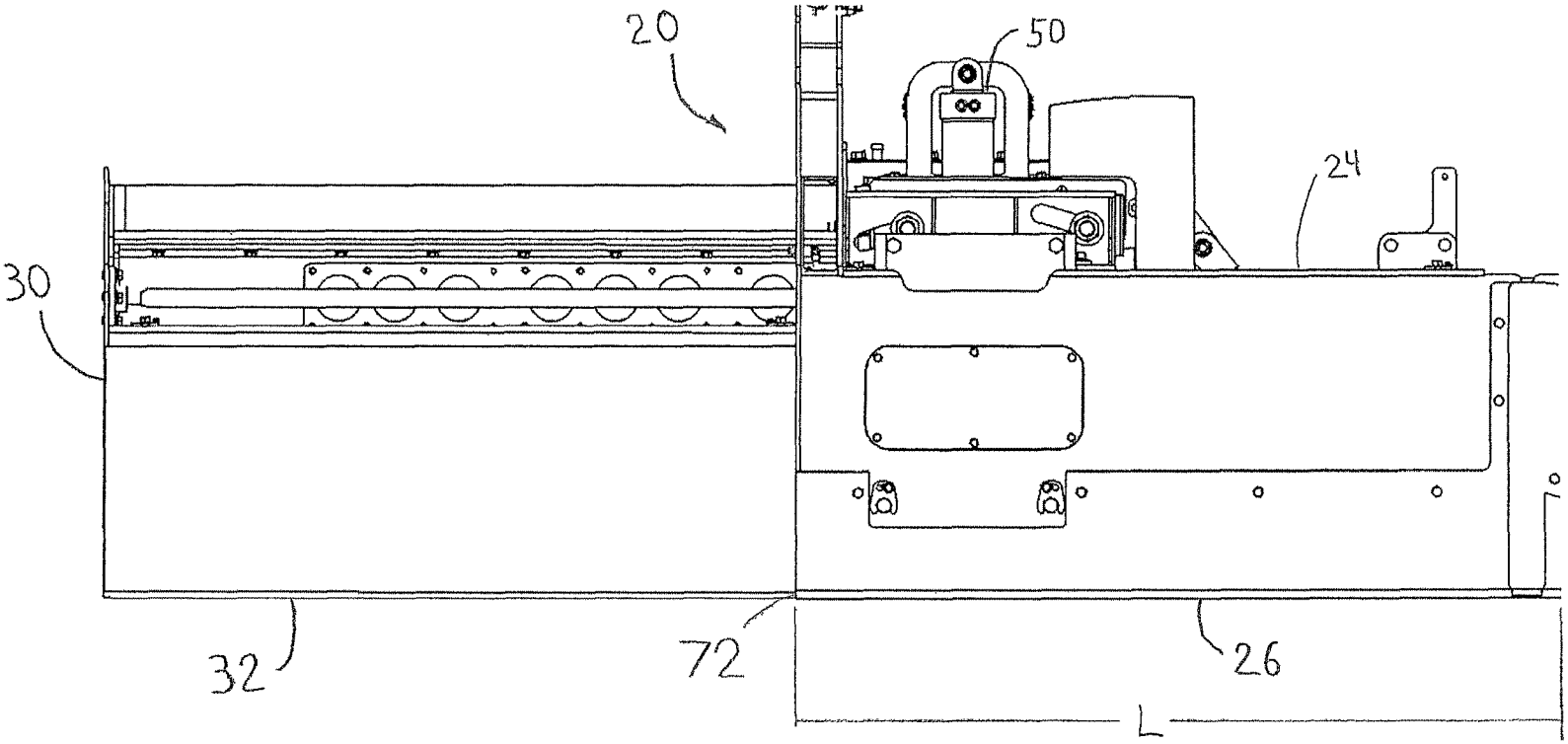
FIG. 7 is a front view of the preferred screed extension control system illustrated in FIGS. 1-3 wherein the screed extension is in a substantially horizontal position.

Referring now to FIG. 7, a front view of preferred screed extension control system 20 is illustrated with preferred screed extension 30 is in a substantially horizontal position. As shown in FIG. 7, preferred screed extension control system 20 comprises main screed 24, main screed contact surface 26 with main screed contact surface length L and main screed contact surface edge 72, screed extension 30, screed extension contact surface 32, and height hydraulic cylinder 50.

Figure 8:
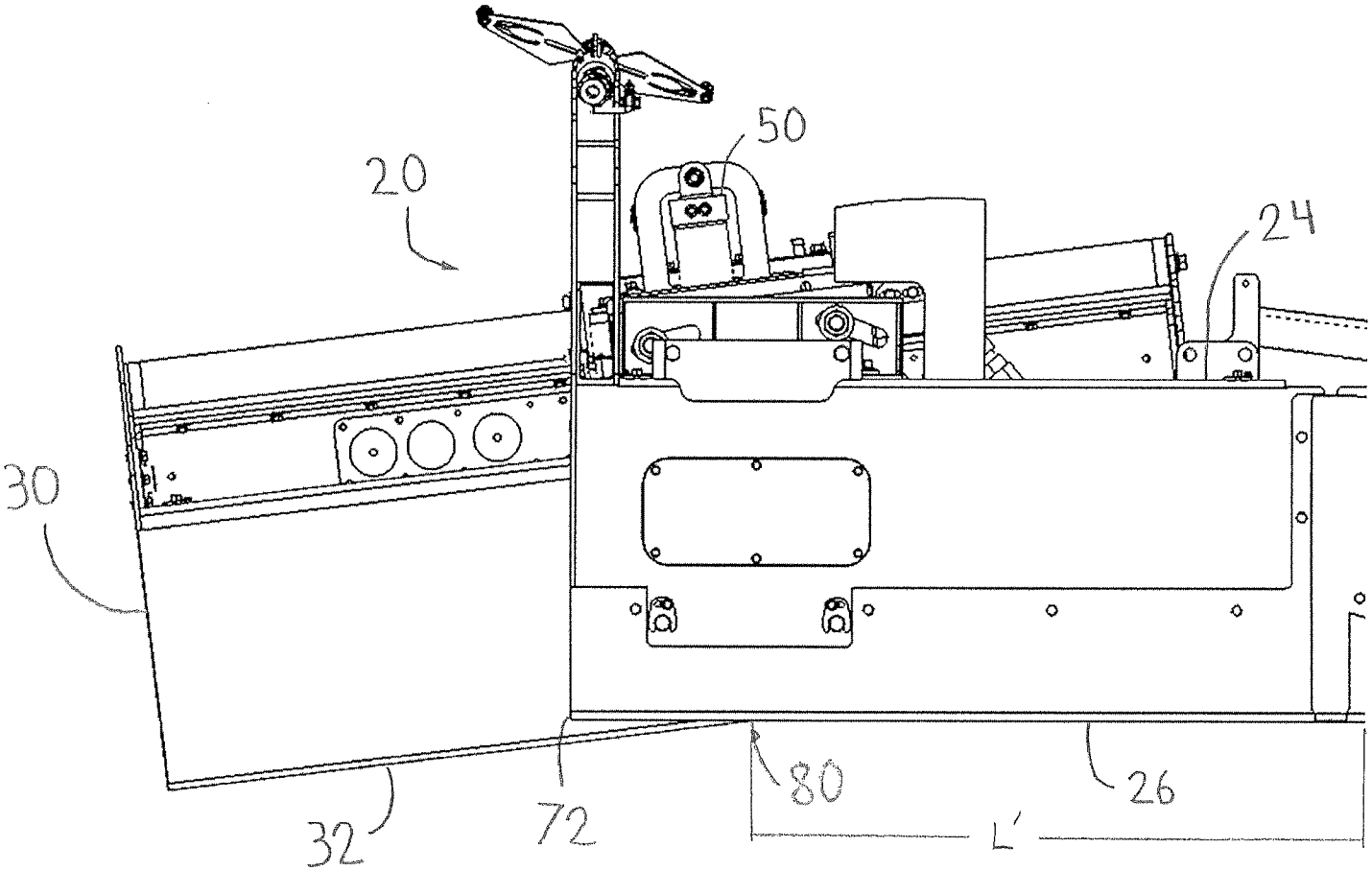
FIG. 8 is a front view of the preferred screed extension control system illustrated in FIGS. 1-3 and 7 wherein the screed extension is in a sloped position and the height is not adjusted.

Referring now to FIG. 8, a front view of preferred screed extension control system 20 is illustrated with screed extension 30 in a sloped position before height hydraulic cylinder 50 has been adjusted. As shown in FIG. 8, main screed contact surface 26 and screed extension contact surface 32 intersect at virtual pivot point location 80 which is not located on main screed contact surface edge 72. After sloping, main screed 24 comprises main screed contact surface length L' which is different from L (see FIGS. 7 and 9).

Figure 9:
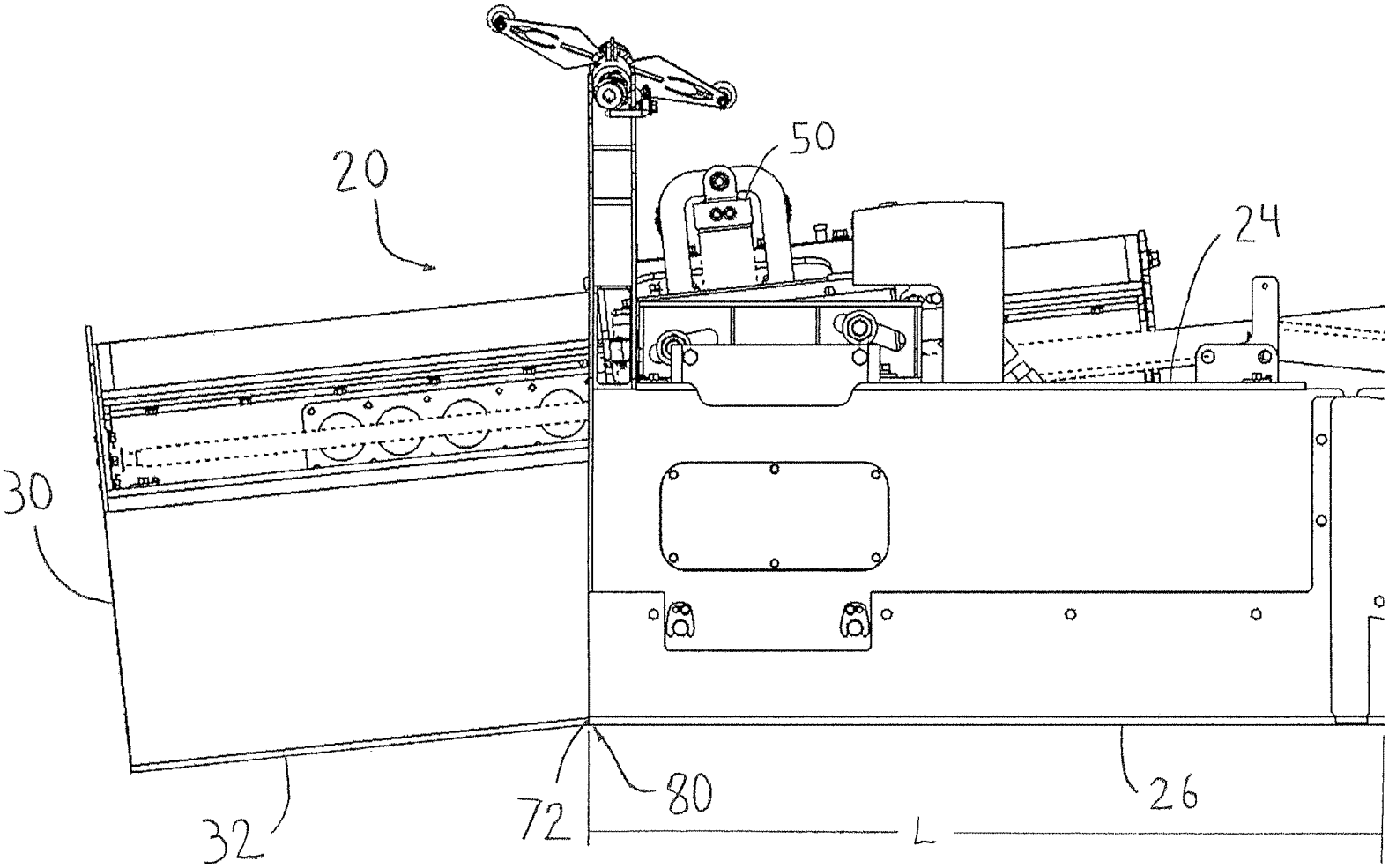
FIG. 9 is a front view of the preferred screed extension control system illustrated in FIGS. 1-3 and 7-8 wherein the screed extension is in a sloped position and the height is adjusted.

Referring now to FIG. 9, a front view of preferred screed extension control system 20 is illustrated with screed extension 30 in a sloped position after height hydraulic cylinder 50 has been adjusted to account for the slope. As shown in FIG. 9, virtual pivot point location 80 is on main screed contact surface edge 72 so main screed contact surface length L is substantially the same as the main screed contact surface length L prior to sloping screed extension 30 as shown in FIG. 7.

Referring now to FIG. 10, a back sectional view of preferred screed extension control system 20 is illustrated. Preferred screed extension control system 20 comprises height actuator subassembly 220. Preferred height actuator subassembly 220 comprises main screed hinge 222, slope actuator support member 224, height actuator support member 226, at least one rod, such as two telescoping rods 228, and screed extension support member 230. Preferred slope hydraulic cylinder second end 240 is connected to slope actuator support member 224. Preferred height hydraulic cylinder first end 52 is connected to height actuator support member 226 and preferred height hydraulic cylinder second end 250 is connected to screed extension support member 230. Preferred screed extension support member 230 moves substantially parallel to two telescoping rods 228. Preferred screed extension support member 230 is operatively connected to the screed extension. Mechanical pivot point location 260 is defined by the position where main screed hinge 222 is attached to main screed 24. Preferred height actuator subassembly 220 pivots around mechanical pivot point location 260.

Still referring to FIG. 10, preferred slope hydraulic cylinder 40 is in a retracted position and preferred height hydraulic cylinder 50 is in an extended position. This configuration of height actuator subassembly 220 causes screed extension 30 to be in a substantially horizontal position and causes main screed contact surface 26 and the screed extension contact surface to be at substantially the same height (see also FIGS. 1, 4, and 7).

Figure 11:
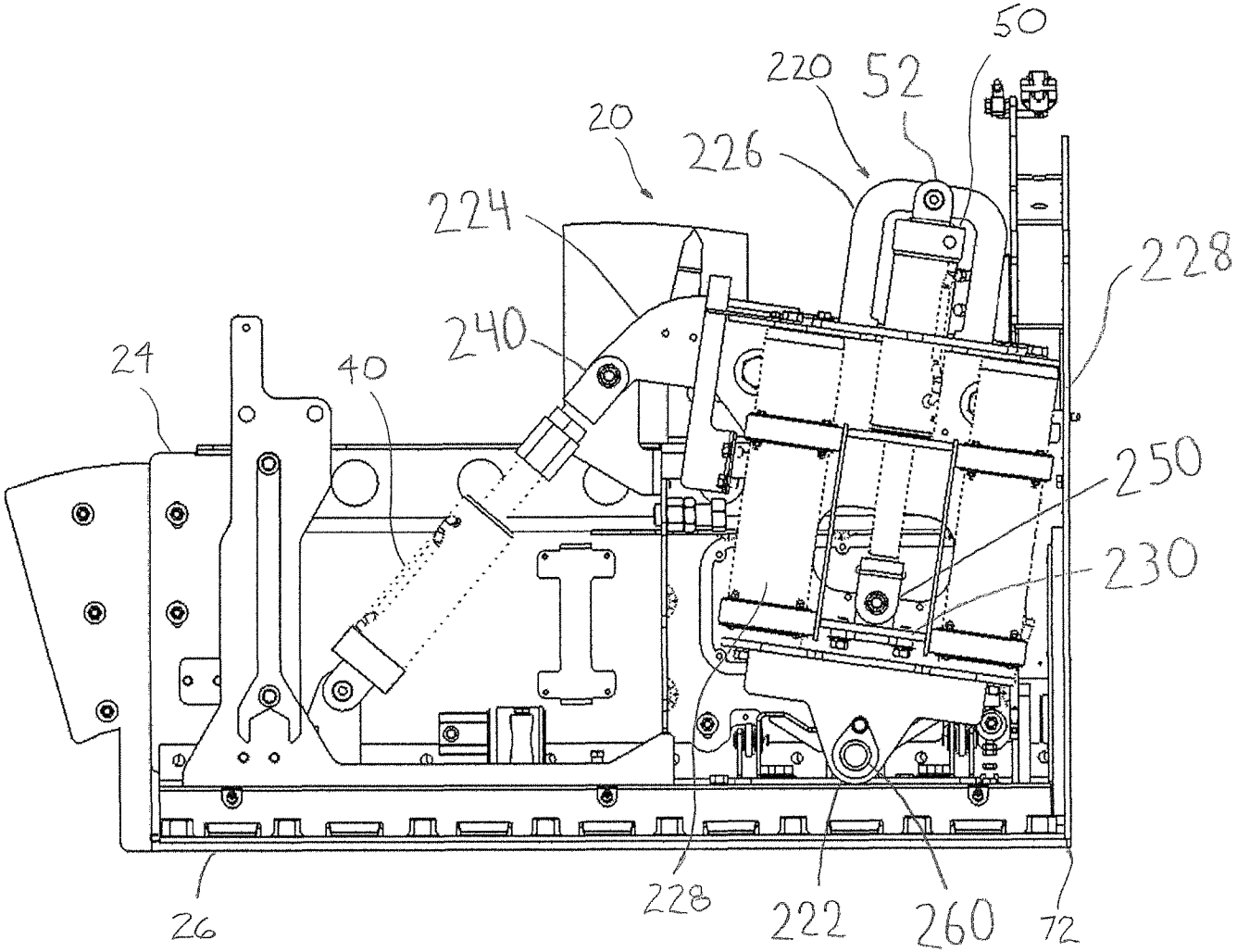
FIG. 11 is a back sectional view of the preferred screed extension control system illustrated in FIGS. 1-3 and 7-10 where the slope actuator is in an extended position and the height actuator is in an extended position.

Referring to FIG. 11, a back sectional view of preferred screed extension control system 20 showing height actuator subassembly 220 is illustrated. Slope hydraulic cylinder 40 is in an extended position and height hydraulic cylinder 50 is in an extended position which causes the screed extension to be in a sloped position and the virtual pivot point location is not located at main screed contact surface edge 72 (see also FIGS. 2, 5, and 8).

Figure 12:
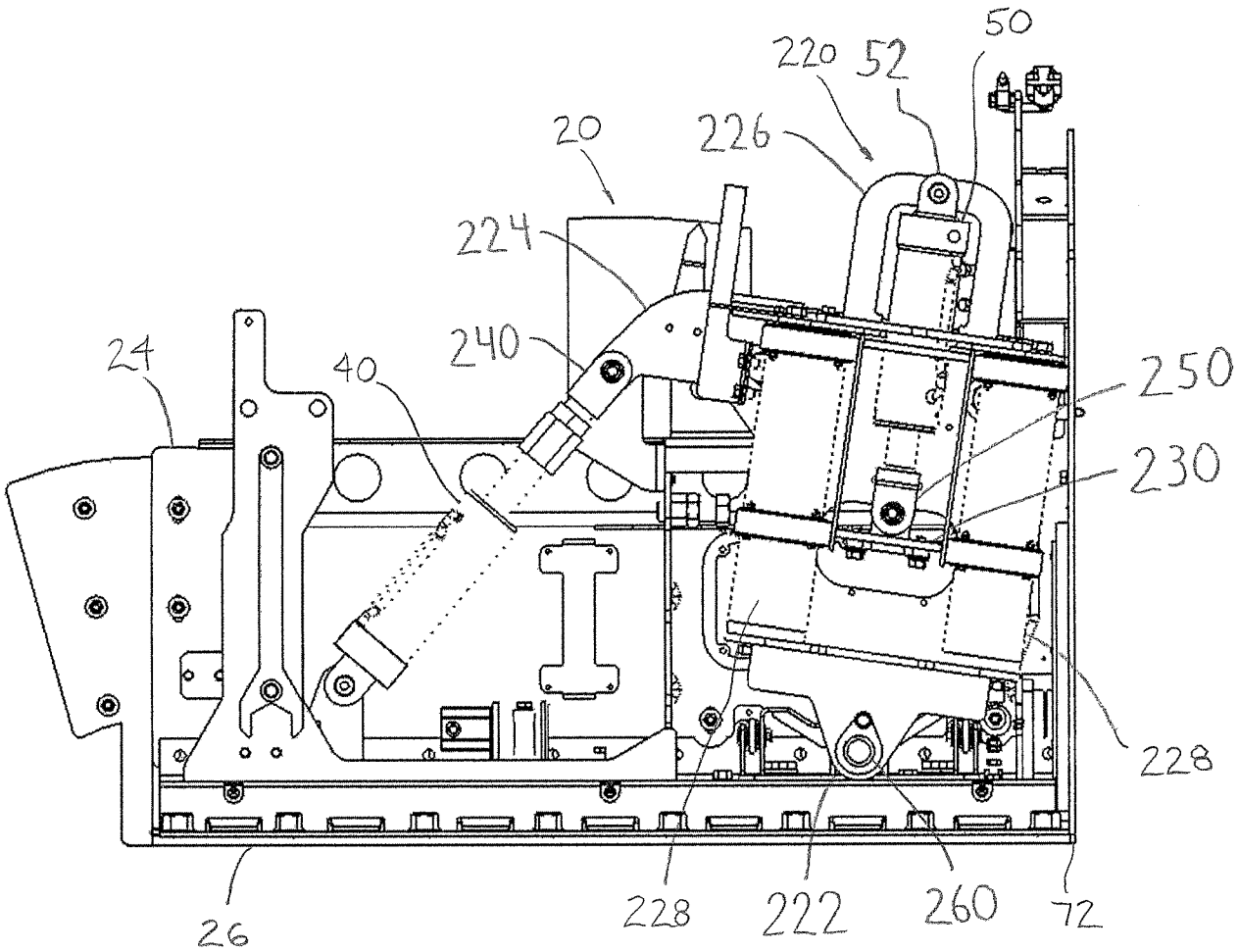
FIG. 12 is a back sectional view of the preferred screed extension control system illustrated in FIGS. 1-3 and 7-11 where the slope actuator is in an extended position and the height actuator is in a retracted position.

Referring now to FIG. 12, a back sectional view of preferred screed extension control system 20 showing height actuator subassembly 220 is illustrated. Slope hydraulic cylinder 40 is in an extended position and height hydraulic cylinder 50 is in a retracted position which causes the screed extension to be in a sloped position and the virtual pivot point location is located at main screed contact surface edge 72 (see also FIGS. 3, 6, and 9).

Figure 13:
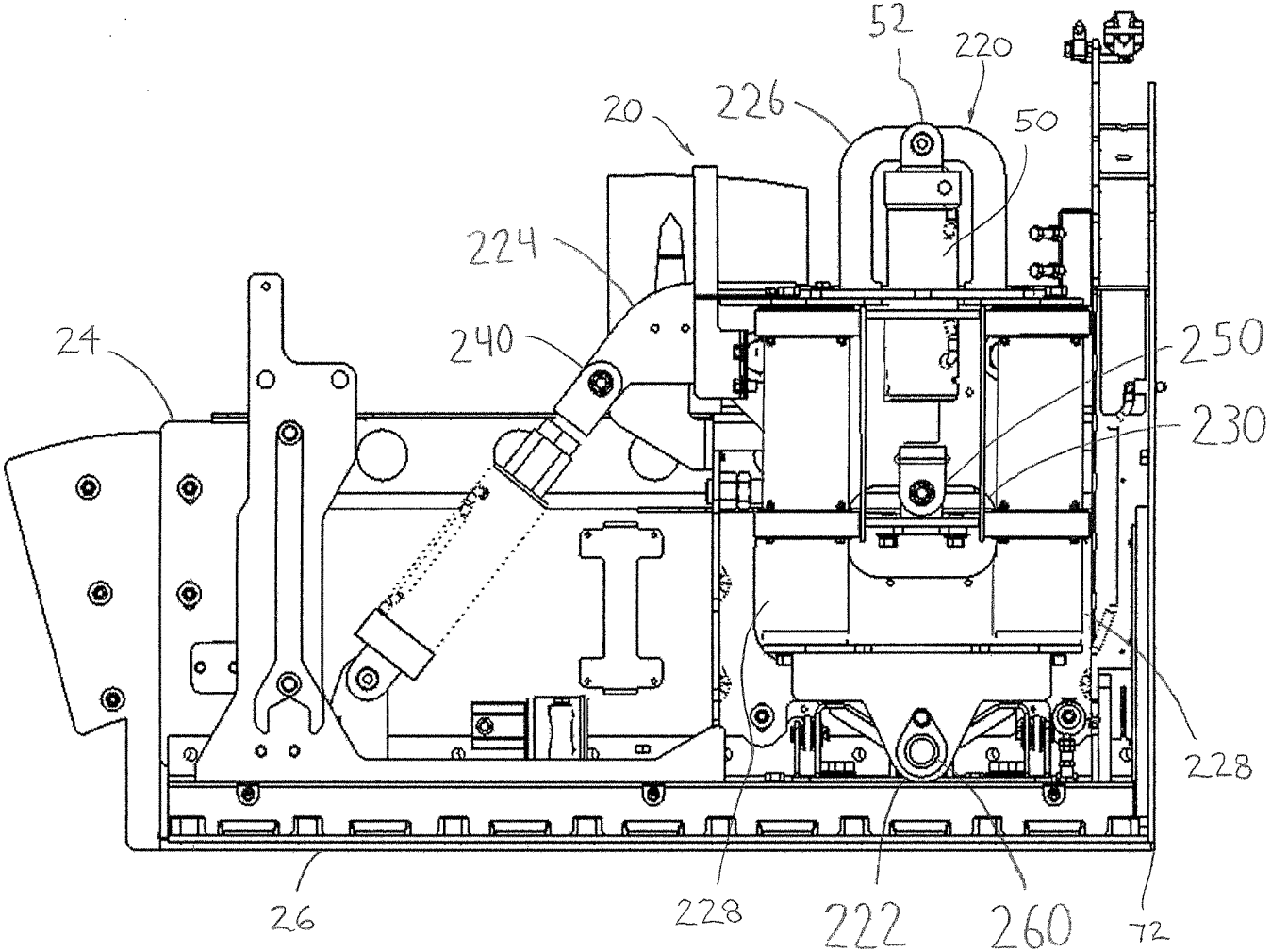
FIG. 13 is a back sectional view of the preferred screed extension control system illustrated in FIGS. 1-3 and 7-12 where the slope actuator is in a retracted position and the height actuator is in a retracted position.

Referring now to FIG. 13, a back sectional view of preferred screed extension control system 20 showing height actuator subassembly 220 is illustrated. Slope hydraulic cylinder 40 is in a retracted position and height hydraulic cylinder 50 is in a retracted position which causes the screed extension contact surface to be in a substantially horizontal disposition that is elevated relative to main screed contact surface 26.

Figure 14:
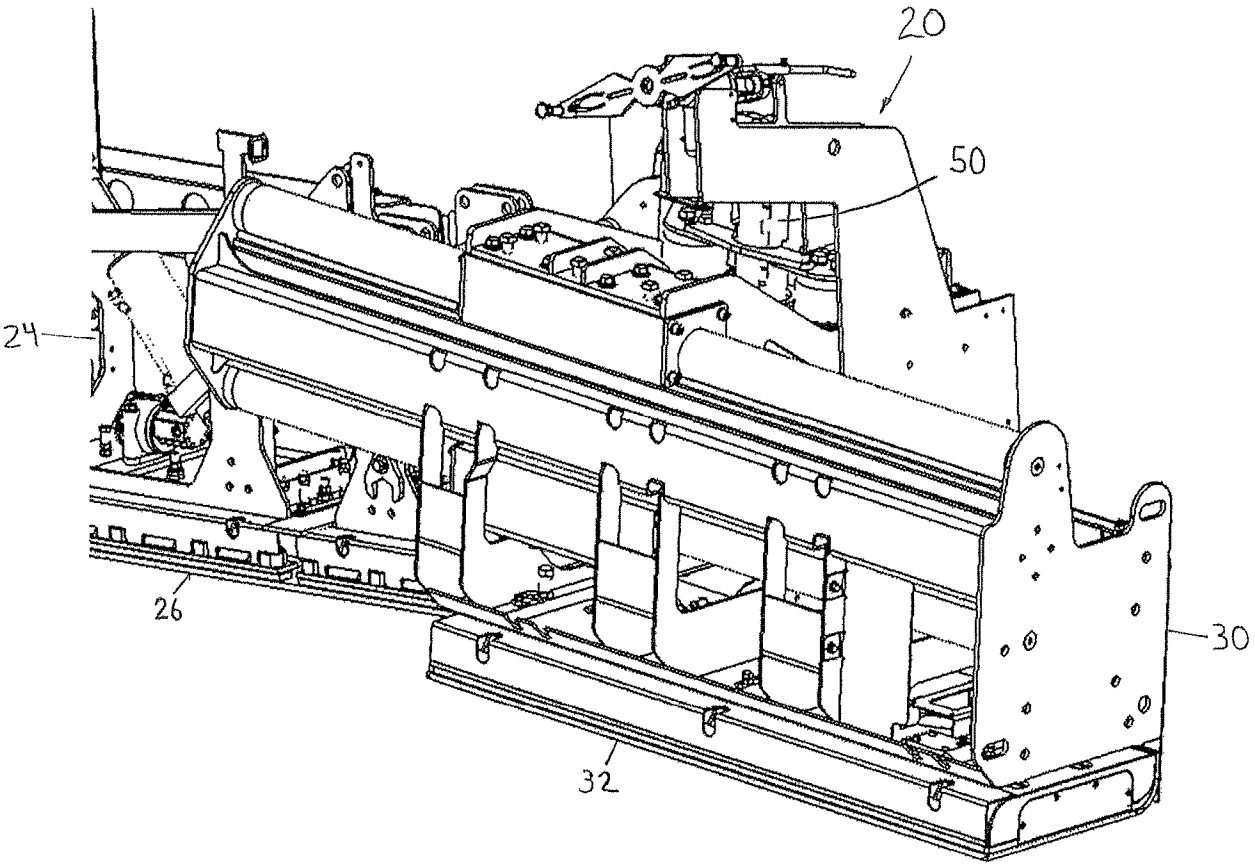
FIG. 14 is a perspective view of the preferred screed extension control system illustrated in FIGS. 1-3 and 7-13.

Referring now to FIG. 14, a perspective view of preferred screed extension control system 20 is illustrated. As shown in FIG. 14, preferred screed extension control system 20 comprises main screed 24, main screed contact surface 26, screed extension 30, screed extension contact surface 32, and height hydraulic cylinder 50.

The invention also comprises a method for adjusting a screed extension position relative to a main screed. The preferred method comprises providing a screed extension control system adapted for use on a screed assembly having a main screed, a main screed contact surface, a screed extension, and a screed extension contact surface. The preferred screed extension control system comprises a slope actuator having a slope actuator first end connected to the main screed and a slope actuator second end operatively connected to the screed extension, a height actuator having a height actuator first end operatively connected to the main screed and a height actuator second end operatively connected to the screed extension, at least one sensor that is adapted to determine a position of at least one of the slope actuator and the height actuator, and a controller that is adapted to receive feedback from the at least one sensor. In the preferred embodiments of the screed extension control system, a virtual pivot point location is defined by a position where the main screed contact surface and the screed extension contact surface intersect, the at least one sensor provides feedback to the controller, and the controller causes at least one of the slope actuator and the height actuator to move between an extended position and a retracted position to control the position of the virtual pivot point location along the length of the main screed. The preferred method also comprises adjusting the screed extension position relative to the main screed.

Figure 15:
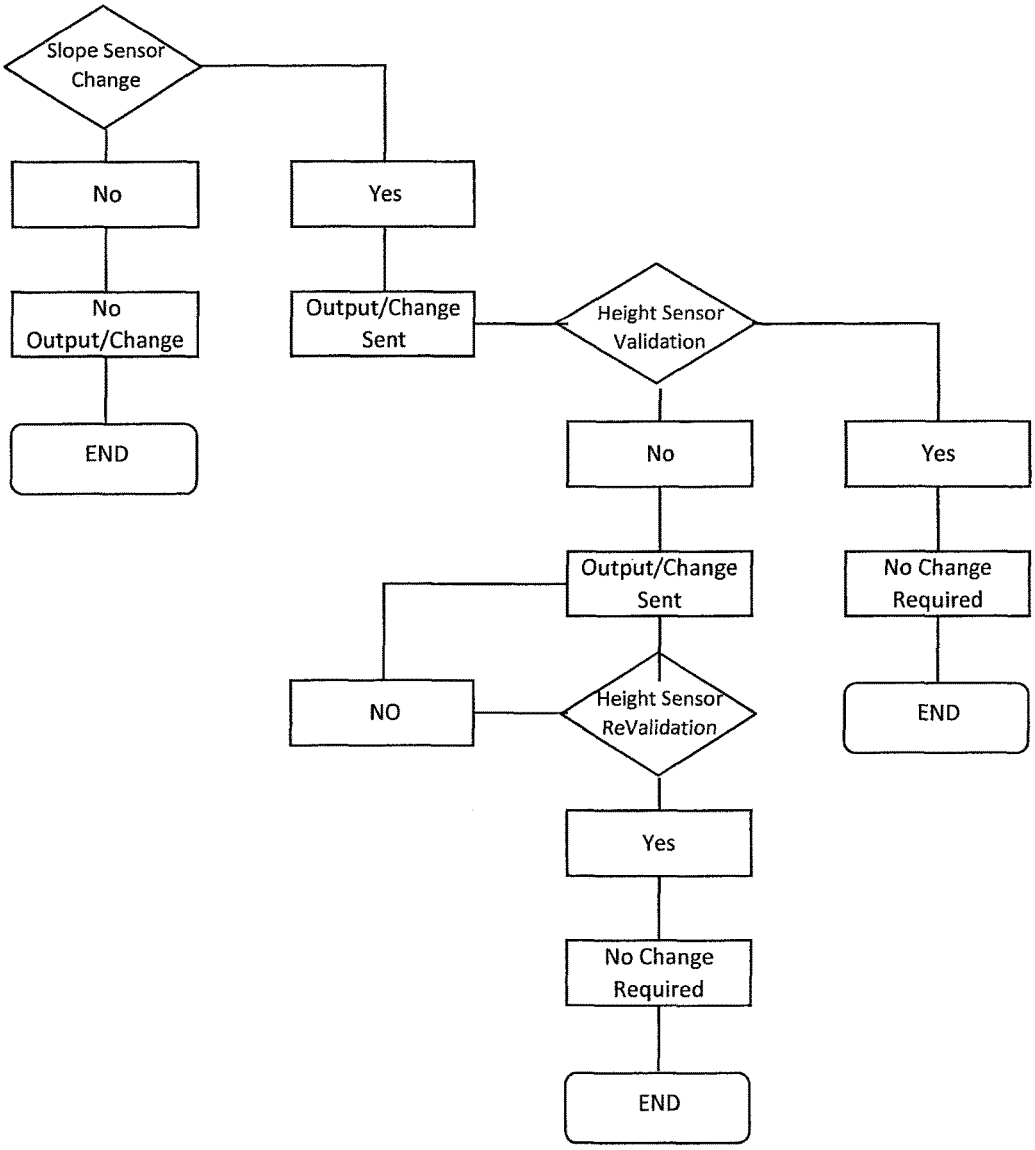
FIG. 15 is a flow chart of sensor input and control output to produce a desired height adjustment.

Referring now to FIG. 15, a flow chart of the preferred method for adjusting the screed extension position relative to the main screed is illustrated. As shown in FIG. 15, the preferred embodiment of the method of the invention further comprises a slope sensor adapted to determine if there has been a change in the position of the slope actuator. If the preferred slope sensor determines that there has been a change in the position of the slope actuator, then the slope sensor conveys a signal or provides feedback to the controller. The preferred embodiment of the method of the invention further comprises the controller conveying a signal to the height actuator after receiving feedback relating to the position of the slope actuator. The signal from the controller causes the height actuator to move between an extended position and a retracted position. The preferred embodiment of the method of the invention further comprises the height sensor conveying a signal or providing feedback relating to the position of the height actuator after the height actuator moves between an extended position and a retracted position to the controller. The preferred embodiment of the method of the invention further comprises the controller validating that the height actuator made the proper adjustment. If validation occurs, the method completes. If not, then the controller conveys a signal to the height actuator which causes the height actuator to move between an extended position and a retracted position until validation occurs. The preferred embodiment of the method of the invention further comprises the controller determining what signal to send to the height actuator based on the feedback relating to the position of the slope actuator or the feedback relating to the position of the height actuator.

In operation, several advantages of the preferred embodiments of the apparatus and method for a screed extension control system are achieved. For example, the preferred embodiments of the invention provide an apparatus and method for a screed extension control system that maintains a virtual pivot point along the length of the main screed contact surface. The preferred embodiments of the invention further provide an apparatus and method for a screed extension control system that can meet more road specifications accurately. The preferred embodiments of the invention further provide an apparatus and method for a screed extension control system that is capable of positioning a screed extension more safely, more quickly, and with less labor.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, and the same are intended to be comprehended within the meaning and range of equivalents of the appended claims.

What is claimed is:

1. A screed extension control system adapted for use on a screed assembly having a main screed, a main screed contact surface, a screed extension, and a screed extension contact surface, said screed extension control system comprising:

(a) a slope actuator having a slope actuator first end connected to the main screed and a slope actuator second end operatively connected to the screed extension;

(b) a height actuator having a height actuator first end operatively connected to the main screed and a height actuator second end operatively connected to the screed extension;

(c) at least one sensor, said at least one sensor being adapted to determine a position of at least one of the slope actuator and the height actuator;

(d) a controller, said controller being adapted to receive feedback from the at least one sensor;

(e) a height actuator subassembly comprising a main screed hinge, a slope actuator support member connected to the slope actuator second end, a height actuator support member connected to the height actuator first end, at least one rod, a screed extension support member connected to the height actuator second end and being adapted to move vertically along the at least one rod and operatively connected to the screed extension;

wherein a virtual pivot point location is defined by a position where the main screed contact surface and the screed extension contact surface intersect; and wherein the at least one sensor provides feedback to the controller; wherein the controller causes at least one of the slope actuator and the height actuator to move between an extended position and a retracted position to control the position of the virtual pivot point location along the length of the main screed; wherein a mechanical pivot point location is defined by a position where the main screed hinge is attached to the main screed, and wherein the height actuator subassembly pivots around the mechanical pivot point location.

2. The screed extension control system of claim 1 wherein the main screed contact surface comprises a main screed contact surface length and a main screed contact surface edge, and wherein the controller maintains the virtual pivot point location on the main screed contact surface edge so that the main screed contact surface length remains substantially constant when the screed extension moves between a substantially parallel position and a sloped position.

3. The screed extension control system of claim 1 wherein the controller causes at least one of the slope actuator and the height actuator to move between an extended position and a retracted position to control the position of the virtual pivot point location along the length of the main screed automatically as the screed extension moves between a substantially parallel position and a sloped position.

4. The screed extension control system of claim 1 wherein the controller causes at least one of the slope actuator and the height actuator to move between an extended position and a retracted position to control the position of the virtual pivot point location along the length of the main screed after the screed extension moves between a substantially parallel position and a sloped position.

5. The screed extension control system of claim 1 wherein the slope actuator and the height actuators are linear actuators.

6. The screed extension control system of claim 1 wherein the slope actuator and the height actuators are cylinders.

7. The screed extension control system of claim 1 wherein the at least one rod consists of two telescoping rods.

8. The screed extension control system of claim 1 wherein the controller comprises a programmable logic controller.

9. The screed extension control system of claim 1 wherein the controller comprises a microprocessor.

10. The screed extension control system of claim 1 wherein the at least one sensor is located inside at least one of the slope actuator and the height actuator.

11. The screed extension control system of claim 1 wherein the at least one sensor is located outside of at least one of the slope actuator and the height actuator.

12. The screed extension control system of claim 1 wherein the at least one sensor comprises a slope actuator sensor adapted to provide feedback relating to the position of the slope actuator to the controller and a height actuator sensor adapted to provide feedback relating to the position of the height actuator to the controller.

13. A screed extension control system adapted for use on a screed assembly having a main screed, a main screed contact surface, a screed extension, and a screed extension contact surface, said screed extension control system comprising:

(a) a height actuator subassembly having a main screed hinge, a slope actuator support member, a height actuator support member, at least one rod, and a screed extension support member that is operatively connected to the screed extension;

(b) a slope actuator having a slope actuator first end connected to the main screed and a slope actuator second end connected to the slope actuator support member;

(c) a height actuator having a height actuator first end connected to the height actuator support member and a height actuator second end connected to the screed extension support member;

(d) at least one sensor, said at least one sensor being adapted to determine a position of at least one of the slope actuator and the height actuator;

(e) a controller, said controller being adapted to receive feedback from the at least one sensor;

wherein a virtual pivot point location is defined by a position where the main screed contact surface and the screed extension contact surface intersect; wherein a mechanical pivot point location is defined by a position where the main screed hinge is attached to the main screed; wherein the height actuator subassembly pivots around the mechanical pivot point location; wherein the screed extension support member moves vertically along the at least one rod; wherein the at least one sensor provides feedback to the controller; and wherein the controller causes at least one of the slope actuator and the height actuator to move between an extended position and a retracted position to control the position of the virtual pivot point location along the length of the main screed as the screed extension moves between a substantially parallel position and a sloped position.

14. The screed extension control system of claim 13 wherein the main screed contact surface comprises a main screed contact surface length and a main screed contact surface edge, and wherein the controller maintains the virtual pivot point location on the main screed contact surface edge so that the main screed contact surface length remains substantially constant when the screed extension moves between a substantially parallel position and a sloped position.

15. A method for adjusting a screed extension position relative to a main screed comprising:

(a) a screed extension control system adapted for use on a screed assembly having a main screed, a main screed contact surface, a screed extension, and a screed extension contact surface, said screed extension control system comprising:

(i) a slope actuator having a slope actuator first end connected to the main screed and a slope actuator second end operatively connected to the screed extension;

(ii) a height actuator having a height actuator first end operatively connected to the main screed and a height actuator second end operatively connected to the screed extension;

(iii) at least one sensor, said at least one sensor being adapted to determine a position of at least one of the slope actuator and the height actuator;

(iv) a controller, said controller being adapted to receive feedback from the at least one sensor;

(v) a height actuator subassembly comprising a main screed hinge, a slope actuator support member connected to the slope actuator second end, a height actuator support member connected to the height actuator first end, at least one rod, a screed extension support member connected to the height actuator second end and being adapted to move vertically along the at least one rod and operatively connected to the screed extension;

wherein a virtual pivot point location is defined by a position where the main screed contact surface and the screed extension contact surface intersect; and wherein the at least one sensor provides feedback to the controller; wherein the controller causes at least one of the slope actuator and the height actuator to move between an extended position and a retracted position to control the position of the virtual pivot point location along the length of the main screed; wherein a mechanical pivot point location is defined by a position where the main screed hinge is attached to the main screed, and wherein the height actuator subassembly pivots around the mechanical pivot point location;

(b) adjusting the screed extension relative to the main screed.

16. The method of claim 15 further comprising the step of providing feedback relating to the position of the slope actuator from the at least one sensor to the controller after the screed extension begins moving between a substantially parallel position and a sloped position.

17. The method of claim 15 further comprising the step of conveying a signal to the height actuator from the controller; said signal causing the height actuator to move between an extended position and a retracted position.

18. The method of claim 15 further comprising the step of providing feedback from the at least one sensor relating to the position of the height actuator after the height actuator moves between an extended position and a retracted position.

19. The method of claim 15 further comprising the step of determining a signal the controller sends to the height actuator based on the feedback relating to the position of the slope actuator and the feedback relating to the position of the height actuator.

* * * * *